US007048569B2

(12) United States Patent
Shimizu

(10) Patent No.: US 7,048,569 B2
(45) Date of Patent: May 23, 2006

(54) CONNECTOR WITH A RECEPTACLE

(75) Inventor: Tooru Shimizu, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/117,585

(22) Filed: Apr. 28, 2005

(65) Prior Publication Data

US 2005/0245123 A1 Nov. 3, 2005

(30) Foreign Application Priority Data

Apr. 28, 2004 (JP) ..... 2004-133999

(51) Int. Cl.
*H01R 13/627* (2006.01)

(52) U.S. Cl. ..... 439/354; 439/358; 439/655

(58) Field of Classification Search ..... 439/354, 439/358, 357, 353, 655
See application file for complete search history.

(56) References Cited

U.S. PATENT DOCUMENTS 5,711,684 A * 1/1998 Inoue et al. ..... 439/354
5,785,546 A * 7/1998 Hamai et al. ..... 439/354
5,860,822 A * 1/1999 Nishide et al. ..... 439/206
5,904,598 A * 5/1999 Yamanashi ..... 439/701
5,910,028 A * 6/1999 Tsuji ..... 439/489
6,019,629 A * 2/2000 Ito et al. ..... 439/489
6,290,527 B1 * 9/2001 Takaya et al. ..... 439/352

FOREIGN PATENT DOCUMENTS

JP 8-31513 2/1996
JP 2000-77159 3/2000

* cited by examiner

*Primary Examiner*—Tulsidas C. Patel
*Assistant Examiner*—Vladimir Imas
(74) *Attorney, Agent, or Firm*—Gerald E. Hespos; Anthony J. Casella

(57) ABSTRACT

Male terminals (2) are pressed into a terminal-accommodating portion (31) of a male housing (3) to be held therein. Receptacles (32) are formed at the opposite sides of the terminal-accommodating portion (31) and surround opposite end portions of the male terminals (2). A locking hole (32*b*) engageable with a locking piece (74) of a corresponding female connector (5) is so formed at the leading end of each receptacle (32) as to communicate the inside and the outside of the receptacle (32). A reinforcing rib (32*c*) for enhancing the strength of each receptacle (32) is formed between the locking hole (32*b*) and an end edge (32*d*) of the receptacle.

9 Claims, 7 Drawing Sheets

CONNECTOR WITH A RECEPTACLE

BACKGROUND OF THE INVENTION

1. Field of the Invention

The invention relates to a connector having a receptacle formed with a locking hole engageable with a locking piece of a mating connector 2. Description of the Related Art Japanese Unexamined Patent Publication No. H08-31513 shows a connector with a receptacle that surrounds terminals. A locking projection is formed at the leading end of the inner side of the receptacle for engaging a locking piece of a mating connector. A hole is formed in the rear of the receptacle to remove a mold that forms the locking projection in the receptacle. However, the mold removal hole is difficult to form on some connectors. For example, Japanese Unexamined Patent Publication No. 2000-77159 discloses a connector with receptacles before and behind a terminal accommodating portion. Through holes engageable with locking pieces of mating connectors must be formed in the receptacle since no mold removal hole can be formed in the terminal accommodating portion. However, the strength of the receptacles is reduced. The locking projection on the receptacle may be formed with a slider core in a shaping mold. However, this increases production cost.

The invention was developed in view of the above and an object thereof is to provide a connector that maintains the strength of a receptacle.

SUMMARY OF THE INVENTION

The invention is directed to a connector that has a housing with a terminal-accommodating portion for holding terminals. A receptacle extends forward from the terminal-accommodating portion to surround the terminals. A locking hole penetrates the receptacle and is engageable with a locking piece of a mating connector and a reinforcing rib is formed between the locking hole and the front edge of the receptacle. The reinforcing rib ensures sufficient strength for the receptacle despite the presence of the locking hole.

The length of the reinforcing rib in the width direction of the housing preferably exceeds the width of the locking hole to enhance the strength of the receptacle despite the presence of the locking hole.

The invention also is directed to an intermediate connector with a housing that has a terminal accommodating portion holding terminals so that opposite ends of the terminals project at the opposite ends of the terminal-accommodating portion. The housing also has two receptacles extending at the opposite sides of the terminal-accommodating portion to surround the terminals. A locking hole penetrates each receptacle and is engageable with a locking piece of a corresponding mating connector. A reinforcing rib is formed between each locking hole and the end edge of the corresponding receptacle. Thus, the receptacle is sufficiently strong even in an intermediate connector that has the mating connectors connected with the opposite sides thereof.

DETAILED DESCRIPTION OF THE PREFERRED EMBODIMENTS

Figure 1:
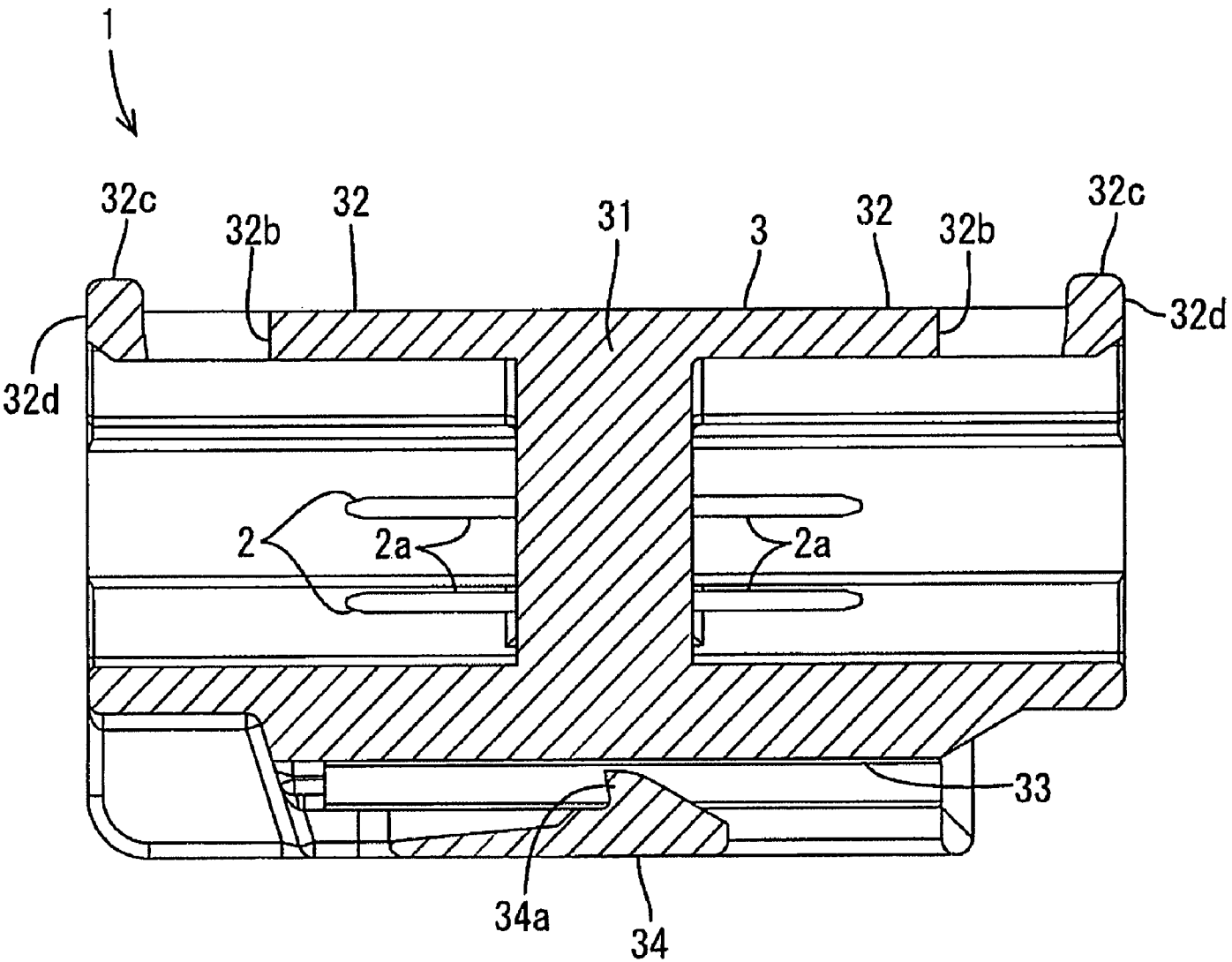
FIG. 1 is a section of a male connector according to one embodiment of the invention.
Figure 2:
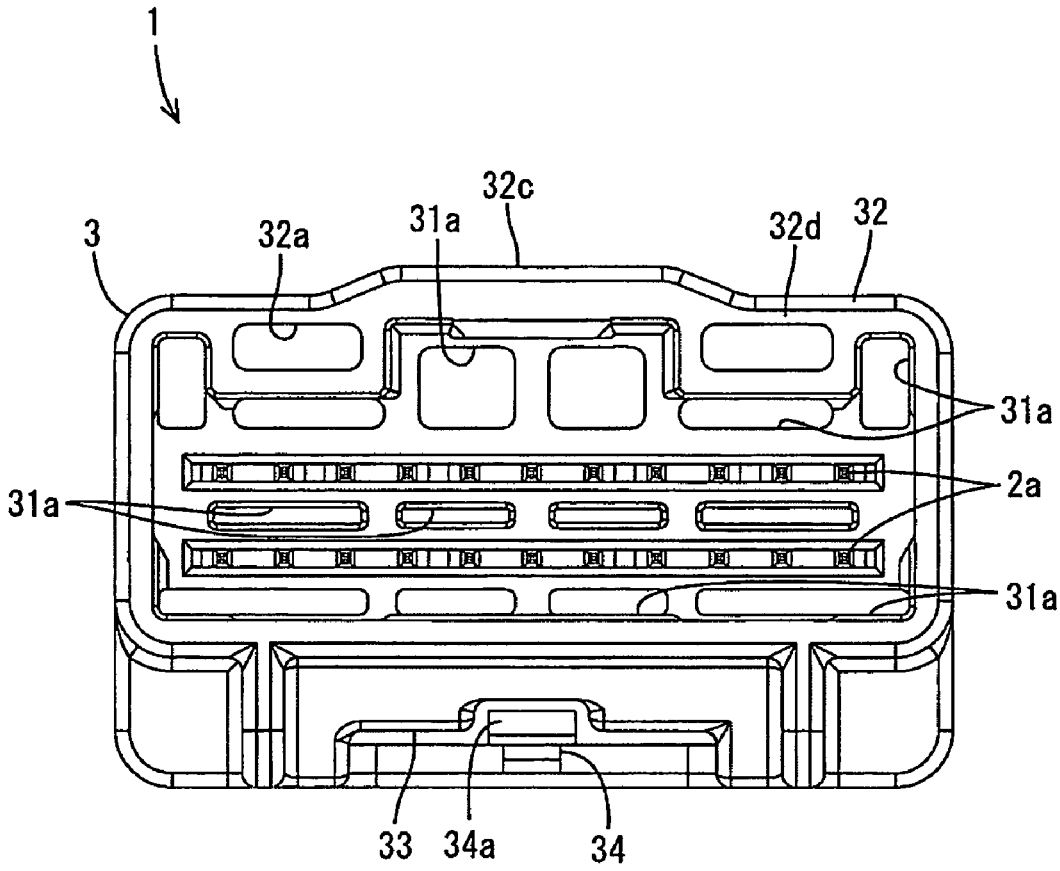
FIG. 2 is a left side view of the male connector shown in FIG. 1.
Figure 3:
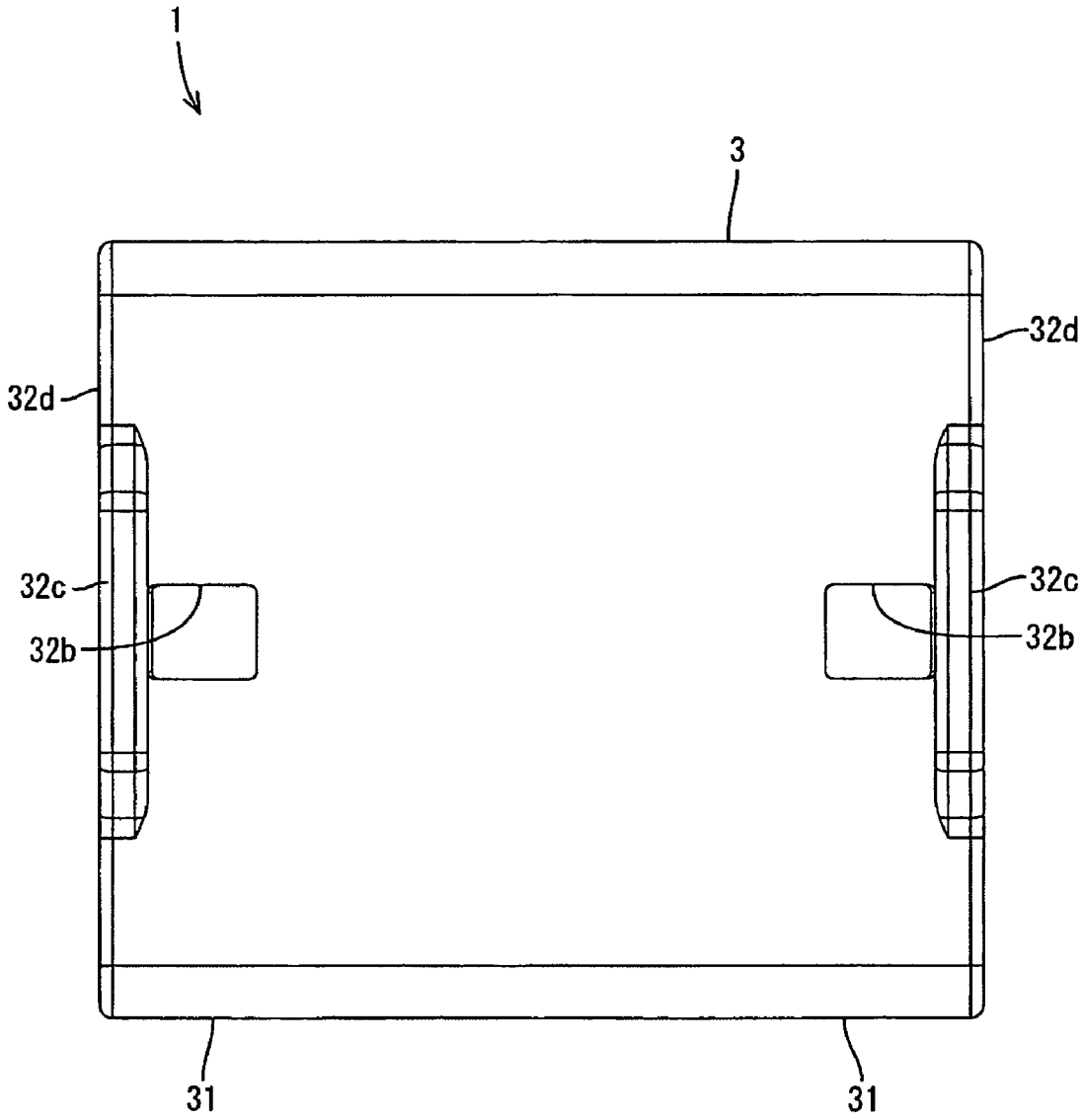
FIG. 3 is a top view of the male connector shown in FIG. 1.

A connector assembly according to the invention is described with reference to FIGS. 1 to 7. In the following description, the right side of FIG. 1 is referred to as the front and the transverse direction of FIG. 2 is referred to as the width direction.

The connector assembly includes a male connector 1 and male terminals 2 are accommodated at upper and lower stages in a terminal-accommodating portion 31 of a male housing 3. The male housing 3 is formed unitarily of a synthetic resin. The terminal-accommodating portion 31 is substantially in the middle of the male housing 3 with respect to forward and backward directions.

The terminal accommodating portion 31 has a rectangular cross section, and the male terminals 2 are pressed into the terminal accommodating portion 31 and held therein while the opposite ends of the male terminals 2 project from the opposite surfaces of the terminal accommodating portion 31. Each male terminal 2 is made of an electrically conductive metal material and has terminal connecting portions 2*a* at the opposite end portions thereof. As shown in FIG. 2, a plurality of small and large bored holes 31*a* are formed in the front and rear surfaces of the terminal accommodating portion 31 to make the male housing 3 lighter.

Receptacles 32 extend respectively at the opposite front and rear ends of the terminal-accommodating portion 31 and surround the male terminals 2. Thus, the male connector 1 typically is referred to as an intermediate connector. As shown in FIG. 2, each receptacle 32 has a rectangular cross section and has two bored portions 32*a* formed in its end surface. A rectangular locking hole 32*b* is formed at a leading end portion of each receptacle 32. The locking holes 32*b* penetrates an upper wall of the receptacle 32 to provide communication between the inside and the outside of the receptacle 32 and is engageable with a locking piece 74 of the female connector 5.

Reinforcing ribs 32*c* project from the upper surfaces of the receptacles 32 for increasing the strength of the receptacles 32. Each reinforcing rib 32*c* has a longitudinal direction aligned along the width direction of the male housing 3. Additionally, each rib 32*c* is between the respective locking holes 32*b* and the corresponding end edge 32*d* of the receptacles 32. A front side of each rib 32*c* is at the end edge 32*d* of the receptacle 32, and a center part of the rear side of each rib 32*c* abuts the respective locking hole 32*b*. As shown in FIG. 2, each rib 32*c* has a trapezoidal shape when viewed in forward and backward directions, and is substantially symmetrical with the respective locking hole 32*b* relative to the width direction. Further, the ribs 32*c* are longer than the locking holes 32*b* along the width direction of the male housing 3 (see FIG. 3). In the illustrated embodiment, the reinforcing ribs 32*c* each have a length that is at least twice the width of the locking hole 32*b*, and preferably about four times the width of the locking hole 32*b*. However, the reinforcing rib 32*c* does not extend the full width of the receptacle 32, and preferably the length of the reinforcing rib 32*c* is about half the width of the receptacle 32. The thickness of each reinforcing rib 32*c* in a front to rear direction preferably is about equal to the thickness of the top wall of the receptacle 32. However, the projecting distance of each reinforcing rib 32*c* from the top wall of the receptacle 32 preferably is less than the thickness of each reinforcing rib 32*c* in the front to rear direction to ensure a small profile for the housing 3.

An insertion hole 33 is formed in the bottom surface of the male housing 3 and penetrates the male housing 3 in forward and backward directions. A holding piece 34 is formed in the insertion hole 33 and is resiliently deformable up and down. An engaging projection 34*a* is formed at the upper end of the holding piece 34. The male connector 1 can be mounted on a vehicle by engaging the engaging projection 34*a* with an unillustrated bracket fixed to the vehicle.

Figure 4:
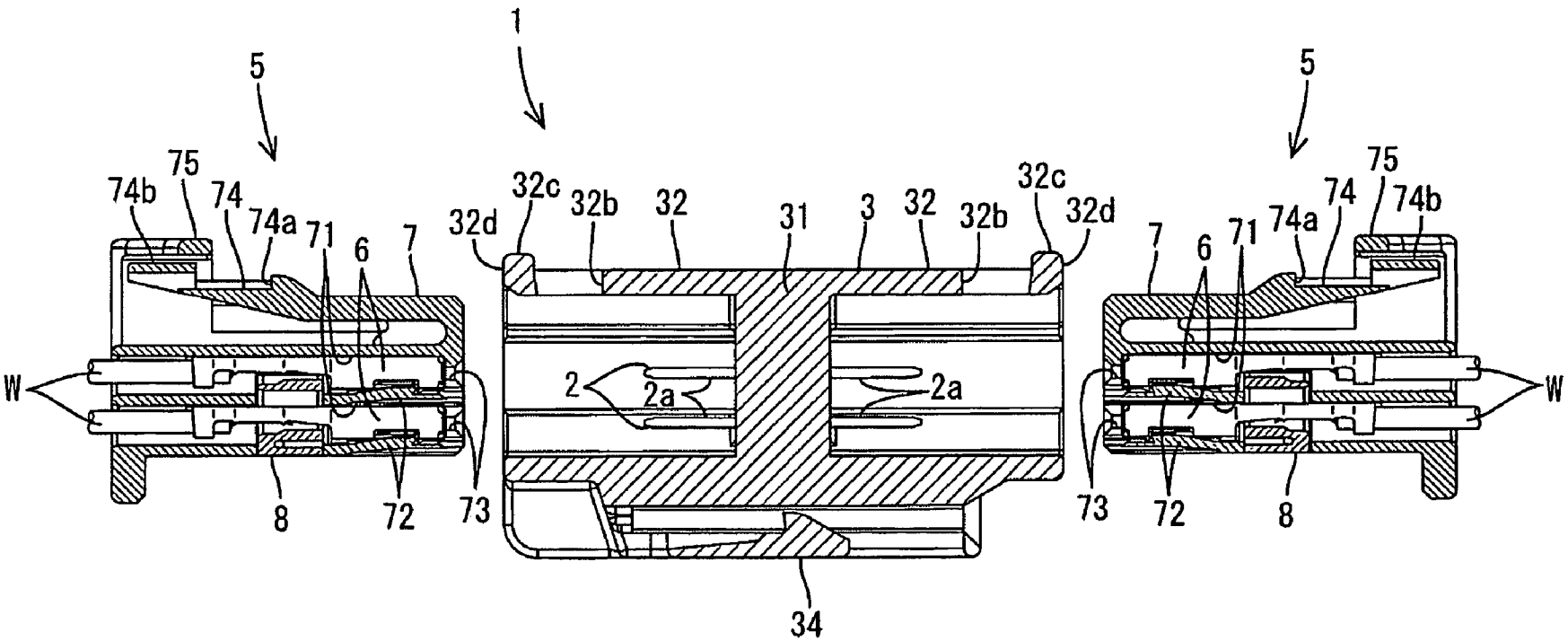
FIG. 4 is a section showing a state before the male and female connectors are connected.
Figure 5:
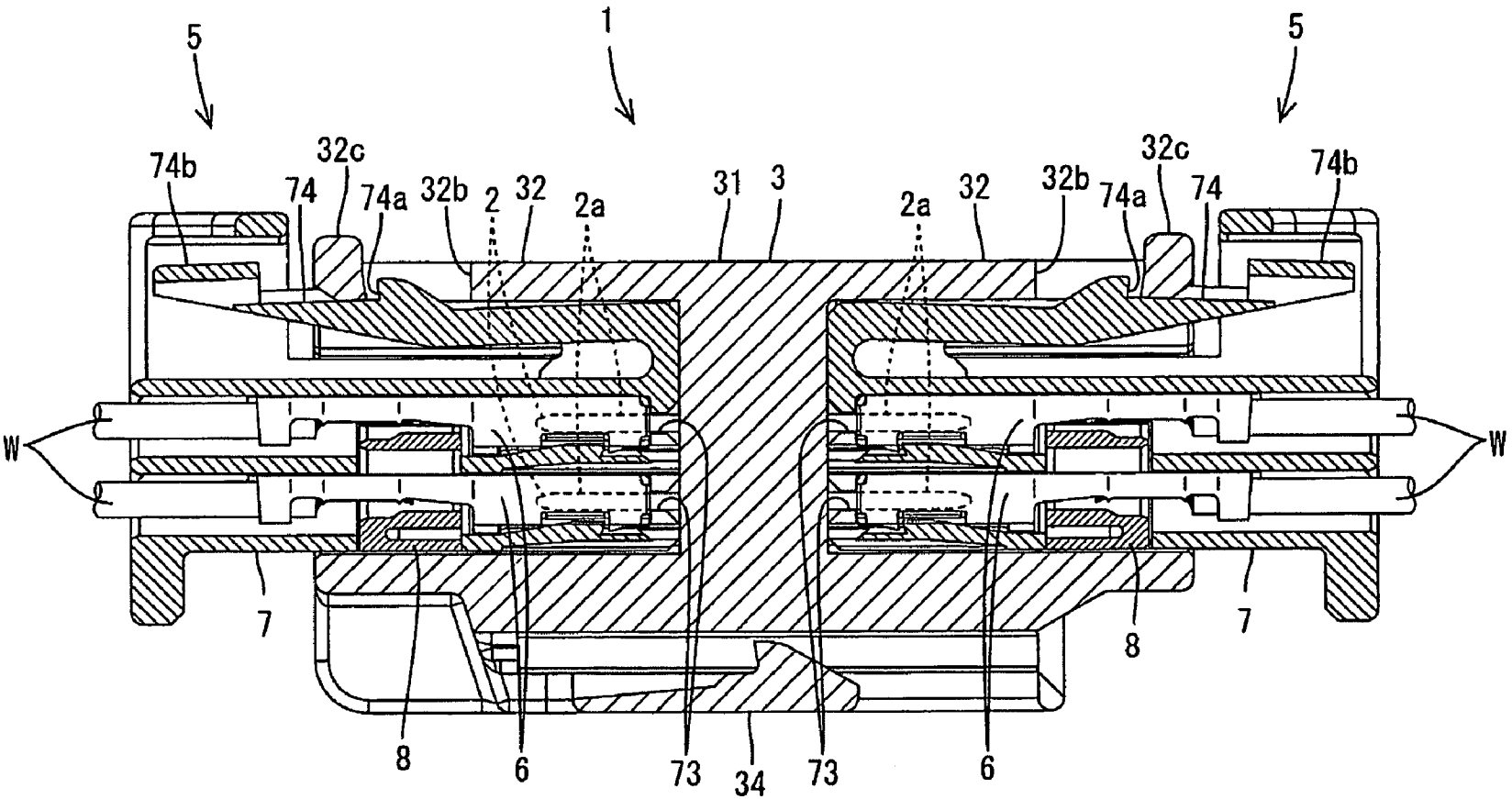
FIG. 5 is a section showing a state where the male and female connectors are connected.
Figure 6:
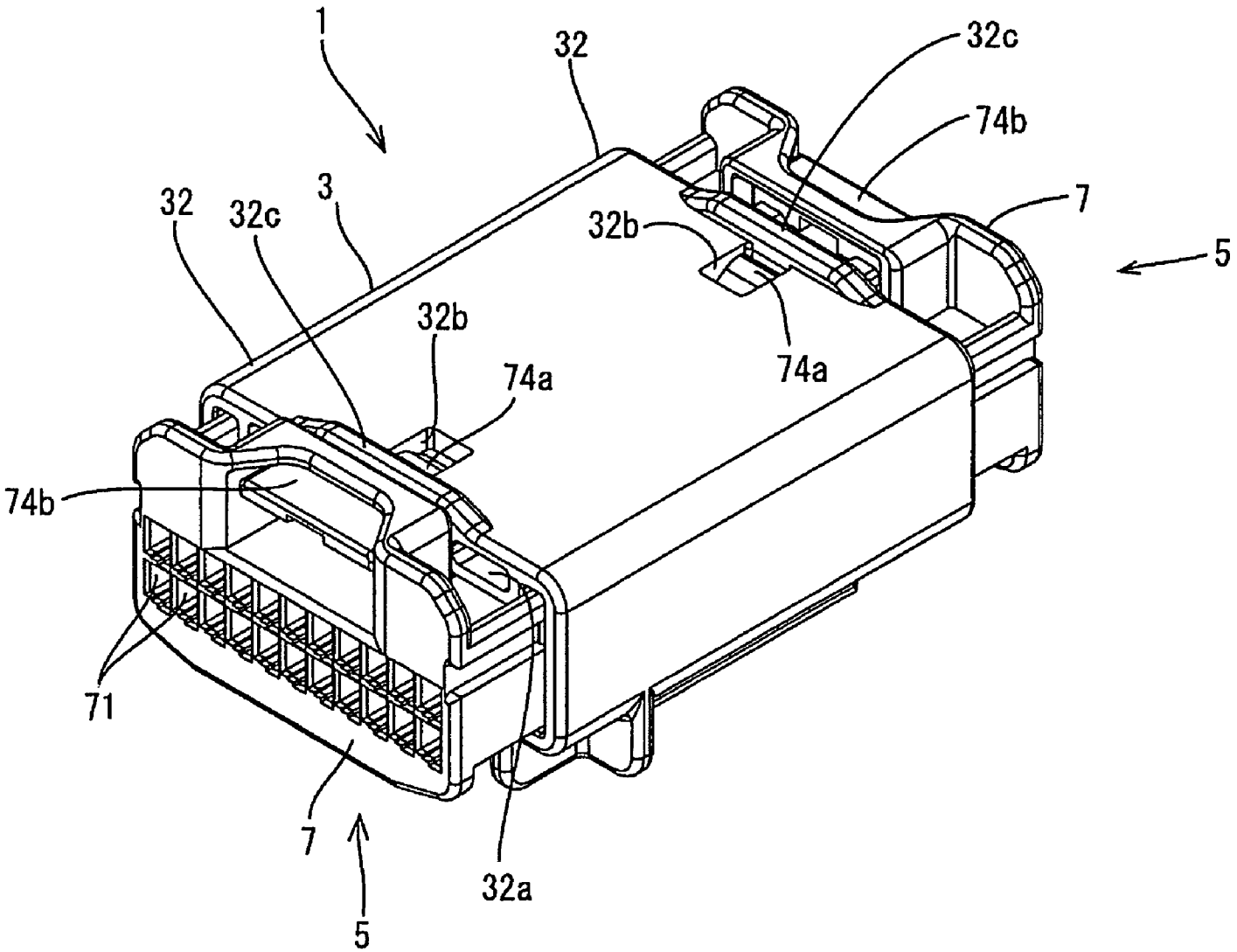
FIG. 6 is a perspective view showing the state of FIG. 5.

The connector assembly also includes substantially identical female connectors 5 that are connected with the male connector 1 from the front and from behind. As shown in FIGS. 4 and 5, the female connectors 5 have female terminals 6 accommodated in cavities 71 of a female housing 7. Each female terminal 6 is made of an electrically conductive metal and is crimped into connection with a wire W. Each housing 7 is made integrally of a synthetic resin. Resiliently deformable locks 72 are formed unitarily with the housing 7 and project into the respective cavities 71. The female terminals 6 deform the locks 72 during insertion into the cavities 71. However, the locks 72 then return resiliently to engage the terminals 6 and hold the terminals 6 in the cavities 71. The female connector 5 further includes a retainer 8 that is formed integrally of a synthetic resin. The retainer 8 is mounted in the female housing 7 for redundantly retaining the female terminals 6. A terminal hole 73 is formed in the front wall of each cavity 71 for receiving a corresponding one of the male terminals 2.

A locking piece 74 is formed at the upper surface of the female housing 7 and is resiliently deformable up and down. A locking projection 74*a* projects atop the locking piece 74 and is engageable with the locking hole 32*b* when the female connector 5 is connected with the male connector 1. An unlocking portion 74*b* is formed at the rear end of the locking piece 74 and can be pressed to deform the locking piece 74 down to permit separation of the male and female connectors 1, 5. A guard 75 is provided above the unlocking portion 74*b* to prevent an operator's hand from inadvertently touching the unlocking portion 74*b*.

The female connectors 5 are fit into the male connector 1 from the front and behind, as shown in FIG. 4. As a result, the terminal connecting portions 2*a* at the opposite ends of the respective male terminals 2 enter the terminal holes 73 of the female connector 5 and engage the female terminals 6 for electrically connecting the female terminals 6 with the male terminals 2. Simultaneously, the locking pieces 74 of the female housings 7 engage the male housing 3 and deform resiliently so that the female housings 7 can enter the corresponding receptacles 32. The locking pieces 74 restore substantially to their original shapes as the connection of the male and female connectors 1, 5 progresses so that the locking projections 74*a* engage the locking holes 32*b* of the male housing 3 (see FIGS. 5 and 6). In this way, the female connectors 5 are locked so as not to come out of the male connector 1.

Figure 7:
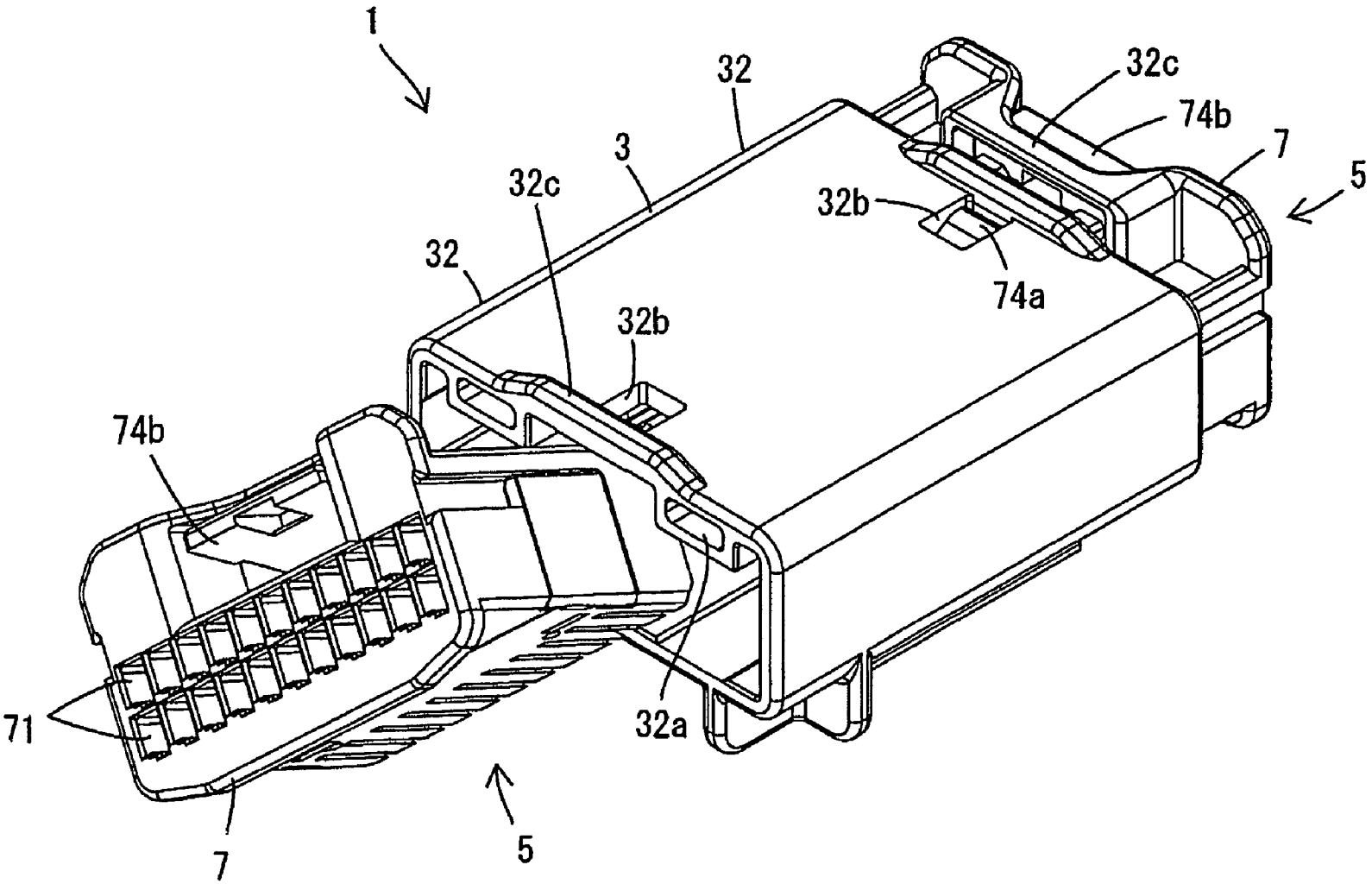
FIG. 7 is a perspective view showing a state where the female connector is fitted in an oblique posture to come into contact with a receptacle of the male housing upon connecting the male and female connectors.

The locking holes 32*b* that engage the locking pieces 74 of the female connectors 5 penetrate the receptacles 32. However, the reinforcing ribs 32*c* are formed between the locking holes 32*b* and the end edges 32*d* of the receptacles 32. Thus, the receptacles 32 are strong despite the presence of the locking holes 32*b* in the receptacles 32. The female housing 7 may be inserted in an oblique posture and may contact the male housing 3 near the locking hole 32*b*, as shown in FIG. 7. However, the reinforcing rib 32*c* ensures that the receptacle 32 is neither deformed nor broken, and the connecting operation is not hindered. The rib 32*c* is formed only locally on the receptacle 32. Hence, there is less interference with other members, the weight of the receptacle 32 is lighter and the material for the receptacle 32 can be saved as compared to a case where the receptacle 32 is reinforced, for example, by being entirely thickened. Further, the enhanced strength ensures that the receptacle 32 will deform less, and therefore an engaging force between the locking hole 32*b* and the locking projection 74*a* will be greater. Furthermore, the reinforcing function of the rib 32*b* is enhanced by making the rib 32*b* longer than the locking hole 32*b* along the width direction of the male housing 3.

The male connector 1 is an intermediate connector and has a terminal-accommodating portion 31 that holds the male terminals 2 so that the opposite ends of the male terminals 2 project at the opposite sides of the terminal-accommodating portion 31. Receptacles 32 extend at opposite sides of the terminal-accommodating portion 31 and surround the male terminals 2. The locking holes 32*b* penetrate each receptacle 32 and engage the locking pieces 74 of the male connectors 5. The reinforcing ribs 32 are formed between the locking holes 32*b* and the end edges 32*d* of the receptacles 32. Thus, the strength of each receptacle 32 of the intermediate connector is sufficient even though there are two receptacle 32 and plural locking holes 32*b*.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The invention also is applicable to a connector having a receptacle only at one side of a terminal accommodating portion and connectors of any other kind.

The reinforcing ribs may have any size and any shape provided that they function to strengthen the receptacles formed with the locking holes.

A plurality of reinforcing ribs may be provided in accordance with the size and shape of the housing.

What is claimed is:

1. A connector, comprising a housing having opposite front and rear ends, a terminal accommodating portion rearward of the front end and configured for holding terminals, a receptacle extending forward in a front to rear direction from the terminal accommodating portion to the front end of the housing for surrounding portions of the terminals, a locking hole penetrating a wall of the receptacle rearward of the front end for engaging a locking piece of a mating connector, and a reinforcing rib between the locking hole and the front end of the receptacle, the reinforcing rib projecting outwardly on the wall of the receptacle in a direction transverse to the front to rear direction so that portions of the receptacle at the reinforcing rib define a thickness in the direction transverse to the front to rear direction that exceeds the thickness of the receptacle at location rearward of the locking hole.

2. The connector of claim 1, wherein the locking hole has a width measured parallel to the front end of the housing, the reinforcing rib has a length measured parallel to the front end of the housing that exceeds the width of the locking hole.

3. The connector of claim 2, wherein the receptacle has a top wall and opposite sidewalls extending angularly from the top wall, the locking hole penetrating the top wall at a location substantially centrally between the sidewalls.

4. The connector of claim 3, wherein the reinforcing rib has a first end between the first and second sidewalls of the receptacle and a second end between the first end and the second sidewall of the receptacle, the reinforcing rib tapering towards the top wall at locations adjacent the first and second ends of the reinforcing rib.

5. The connector of claim 1, wherein the reinforcing rib substantially abuts the front end of the receptacle.

6. The connector of claim 5, wherein the reinforcing rib substantially abuts the locking hole.

7. An intermediate connector, comprising a housing with opposite front and rear ends, the housing having a terminal accommodating portion between the front and rear ends, front and rear receptacles extending in front to rear directions from the opposite sides of the terminal accommodating portion to the respective front and rear ends of the housing, front and rear locking holes penetrating the respective front and rear receptacles in directions transverse to the front to rear direction at locations spaced from the respective front and rear ends of the housing for engaging locking pieces of corresponding mating connectors, a front reinforcing rib formed between the front locking hole and the front end of the housing and a rear reinforcing rib formed between the rear locking hole and the rear end of the housing, the reinforcing ribs projecting outwardly on the housing in a direction transverse to the front to rear direction so that portions of the receptacles having the front and rear reinforcing ribs proiect out farther than portions of the housing between the front and rear locking holes.

8. The intermediate connector of claim 7, wherein front and rear reinforcing ribs are adjacent the respective front and rear ends of the receptacle.

9. The intermediate connector of claim 8, wherein the front and rear reinforcing ribs substantially abuts the respective front and rear locking holes.

* * * * *